United States Patent [19]

Fujii

[11] Patent Number: 4,511,879

[45] Date of Patent: Apr. 16, 1985

[54] SLIDER ARRANGEMENT AND METHOD OF PRODUCING OF THE SAME

[75] Inventor: Shosaku Fujii, Miyagi, Japan

[73] Assignee: Alps Electric Co., Ltd., Tokyo, Japan

[21] Appl. No.: 560,189

[22] Filed: Dec. 12, 1983

[30] Foreign Application Priority Data

Dec. 10, 1982 [JP] Japan ..... 57-215582

[51] Int. Cl.[3] ..... H01C 1/12; H01C 10/34; H01H 19/00; H01R 39/00

[52] U.S. Cl. ..... 338/174; 338/160; 338/162; 338/171; 338/202; 338/130; 338/166

[58] Field of Search ..... 338/174, 160, 162, 166, 338/167, 169, 171, 184, 197, 202, 324, 130; 200/116, 283

[56] References Cited

U.S. PATENT DOCUMENTS

| | | | |
|---|---|---|---|
| 3,617,978 | 11/1971 | Gerstmieser | 338/202 X |
| 3,906,429 | 9/1975 | Rhodes | 338/202 |
| 4,015,231 | 3/1977 | Seno et al. | 338/174 |
| 4,237,443 | 12/1980 | Gass | 338/202 |
| 4,433,322 | 2/1984 | Hirayama et al. | 338/162 |

FOREIGN PATENT DOCUMENTS

| | | | |
|---|---|---|---|
| 817483 | 7/1959 | United Kingdom | 338/171 |
| 961862 | 6/1964 | United Kingdom | 338/174 |

*Primary Examiner*—Roy N. Envall, Jr.
*Assistant Examiner*—C. N. Sears
*Attorney, Agent, or Firm*—Guy W. Shoup; Gerard F. Dunne

[57] ABSTRACT

A slider arrangement comprises an insulator member, and two sliders each made of a resilient metal matel plate embedded in the insulator member and each having slender contacts exposed from the insulator mold member. The slender contacts of each of the sliders forms a pair of contact sets adapted to slide in contact with a resistive element and a collector member respectively, the pair of contact sets of one slider being located between the pair of contact sets of the other slider. A method of producing the above-mentioned slider arrangement comprises the steps of embedding a resilient metal plate having sliders into an insulator member, with contact forming portions of the sliders exposed, cutting off portions bridging the sliders and the contacts formed at the contact forming portions while holding the metal plate by the insulator member, and bending each of the contacts to its proper position.

2 Claims, 6 Drawing Figures

SLIDER ARRANGEMENT AND METHOD OF PRODUCING OF THE SAME

BACKGROUND OF THE INVENTION

1. Field of the Invention

The present invention relates to a slider arrangement used in a variable resistor or the like.

2. Description of the Prior Art

Conventionally, in producing a variable resistor formed by a plurality of ganged resistors operated by a common shaft, a plurality of resistive elements are coaxially disposed on an insulator substrate 1 as shown in FIG. 1. Typically, it is necessary that a first variable resistor pattern A is constituted by a collector ring 2 disposed in the innermost position and a resistive element 3 disposed in the outermost position, and a second variable resistor pattern B is constituted by a collector ring 4 and a resistive element 5 disposed at an intermediate position between the collector ring 2 and the resistive element 3. A first slider 6 and a second slider 7 which are to be slidably in contact with the first and second variable resistor patterns A and B respectively are separately attached to a slider receiver (not shown), resulting in the drawbacks that assembly is complicated and that each of the sliders 6 and 7 may be erroneously located to make it difficult to accurately set the resistance to a correct value.

SUMMARY OF THE INVENTION

An object of the present invention is therefore to eliminate the drawbacks in the prior art.

Another object of the present invention is to provide a slider arrangement and a method of producing the same, in which production is easily performed, in which the relative mislocation of the slider contact portions is reduced or obviated to thereby produce a variable resistor of high performance, in which management of parts can be easily performed, and in which mass production can be suitably performed.

BRIEF DESCRIPTION OF THE DRAWINGS

FIGS. 2 and 3 are plan views illustrating the processes of producing the slider arrangement according to the present invention, in which FIG. 2 shows the state that a metal plate forming sliders has been insert molded and FIG. 3 shows the state that unnecessary portions have been cut away to complete the slider arrangement;

DESCRIPTION OF PREFERRED EMBODIMENT

Referring to FIGS. 2 to 6, an embodiment according to the present invention will be desribed hereunder.

Figure 1:
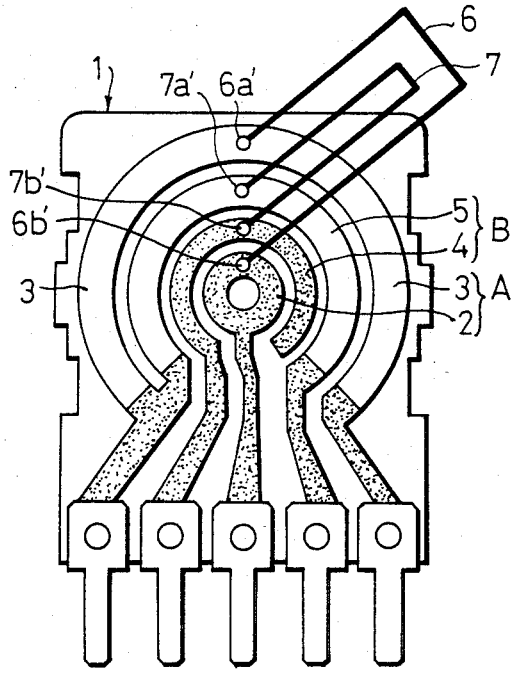
PRIOR ART Fig. 1
FIG. 1 is a diagram for explaining the operation of a variable resistor of the one-shaft gang type.
Figure 2:
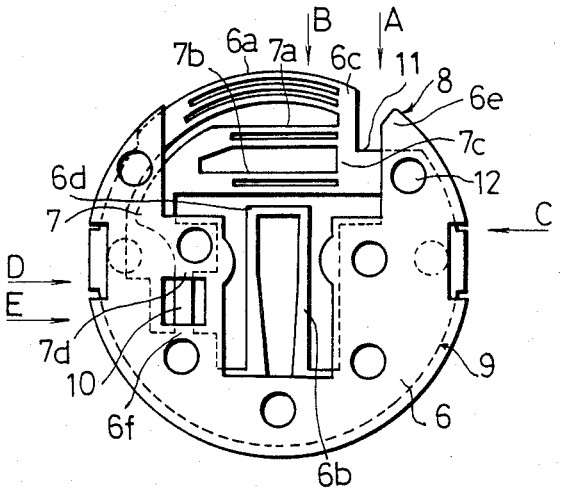
Figure 3:
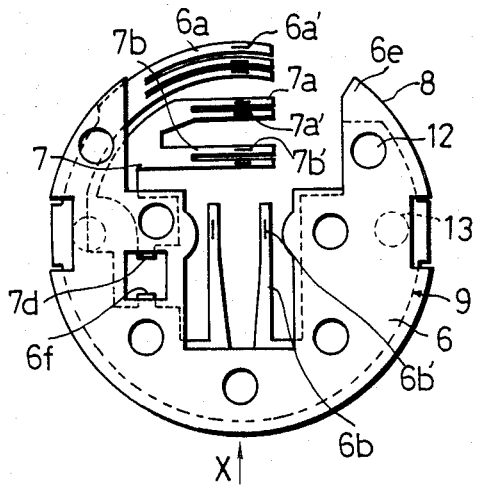

In FIG. 2, reference numeral 8 designates a substantially disc-like insulator member molded from an insulating material such as polyacetal, and 9 designates a resilient metal plate havin a base portion which is insert-molded in the disc-like insulator member 8. The resilient metal plate 9 has a first slider 6 corresponding to a first variable resistor pattern A and a second slider 7 corresponding to a second resistor pattern B. Each of the first end second sliders 6 and 7 has a forward end portion at which contacts are formed and a base portion, the former being exposed while the other being embedded in the insulator mold portion 8.

The first slider 6 is formed with a plurality of slender contacts adapted to contact a resistive member 3 constituting the first variable resistor pattern A and a plurality of slender contacts **6*b* adapted to contact a collector ring 2, the contacts 6*a* and the contacts 6*b* being connected to each other through bridge portions 6*c* and 6*d***.

The second slider 7 is formed with a plurality of slender contacts **7*a* adapted to contact with a resistive member 5 constituting the second variable resistor pattern B and a plurality of slender contacts 7*b* adapted to contact a collector ring 4, the contacts 7*a* and the contacts 7*b* being connected to each other through a bridge portion 7*c* in FIG. 2**.

The contacts **7*a* and 7*b* formed at one end portion of the second slider 7 are positioned to be in opposition to a portion 6*e* of the first slider 6 and connected by a bridge portion 11 therebetween, and the other end 7*d* of the second slider 7 is positioned to be in opposition to a portion 6*f* of the first slider 6 and connected by a bridge portion 10**.

In this state, the bridge portions 10 and 11 are cut off in the directions A, D and E so as to separate the first and second sliders 6 and 7 from each other. Next, the bridge portion **6*d* connecting the contacts 6*b* and the bridge portions 6*c* and 7*c* connecting the contacts 6*a*, 7*a* and 7*b* are simultaneously cut off in the directions C and B so as to separate the respective contacts 6*a*, 6*b*, 7*a* and 7*b*, and thereafter, the base and forward end portions of each of the cntacts 6*a*, 6*b*, 7*a* and 7*b* are subjected to bend-processing so as to form, at their forward ends, contact portions 6*a*′, 6*b*′, 7*a*′ and 7*b*′ which are adapted to be in resilient contact with the resitive elements 3 and 5 and the collector rings 2 and 4** respectively.

Figure 4:
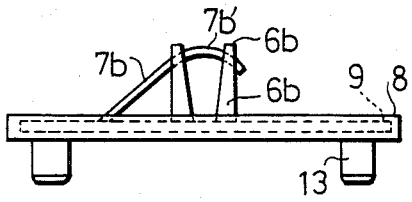
FIG. 4 is a side view when viewed in the direction X in FIG. 3.
Figure 5:
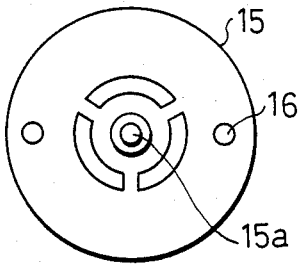
FIG. 5 is a bottom view of a slider receiver.
Figure 6:
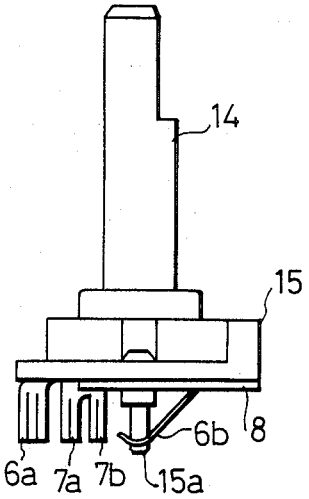
FIG. 6 is a side view of the slider receiver provided with the slider arrangement and a shaft.

Reference numeral 12 designates holes for positioning the metal plate 9 during insert-molding with insulator member 8, and 13 designates a pair of fitting protrusions which are formed at opposite side portions on one surface of the insulator member 8 and which project from the one surface in the direction in opposite to the direction in which the contacts **6*a*, 6*b*, 7*a* and 7*b* extend, as shown in FIG. 4. The protrusions 13 are inserted into a pair of holes 16 formed at opposite side portions with respect to a shaft end 15*a* of a slider receiver 15 made of a synthetic resin material, such as polycarbonate, integrally with a shaft 14, and then fixed thereat by caulking, welding, or the like so that the insulator member 8 is held on the lower surface of the slider receiver 15, as shown in FIGS. 5 and 6**.

The slider arrangement according to the present invention has a structure as described above, and according to the present invention, production is very simple and the mis-location of the respective sliders which has been a drawback in the prior art can be prevented from occuring, since the slider arrangement according to the invention is produced in the manner such that a base portion of a resilient metal plate formed with a plurality of sets of contacts is insert-molded in an insulator member with the contact forming portion exposed, the contact forming portion is then divided into a plurality of contacts, and, thereafter, necessary bend processing is performed. Further, the slider arrangement and the method of pruducing the same according to the present invention are advantageous in that deformation of slender contacts is prevented from occurring during the assembling work to thereby make it possible to simplify the parts management and to attain mass production to reduce cost, and further in that the insulator member in which the sliders are embedded is readily attached to the slider receiver by means of the protrusions integrally provided with the insulator member to thereby improve the efficiency of assembly.

Although an example in which the slider arrangement according to the present invention is applied to a variable resistor has been described, it is a matter of course that the slider assembly can be used in other devices such as a pulse switch, an encoder, etc.

What is claimed is:

1. A slider arrangement for a variable resistor having two resistive elements each adapted to be connected electrically to a respective collector by respective sliders ganged together for simultaneous actuation; said slider arrangement being formed by a member molded from an insulative material and having embedded therein during its molding a resilient metal plate having four elongate contact elements extending outwardly from said member, said metal plate having means including connecting portions serving to connect said contact elements together and exposed from said member so that said connecting members may be severed to isolate said contact elements into two pairs with the contact elements of each pair being connected together and adapted to engage a respective resistive element and associated collector.

2. A slider arrangement according to claim 1, said variable resistor including first and second arcuate collectors arrange coaxially and said two resistive elements including an inner resistive element arranged coaxially around said collectors and a second resistive element arrange coaxially around said first resistive element, one pair of said contact elements being adapted to connect the inner of said collector with the outer of said resistive elements, and the other pair of contact elements being positioned within said one pair and adapted to connect the outer of said collector with the innr of said resistive elements.

* * * * *